United States Patent [19]

Halperin

[11] Patent Number: 5,005,002

[45] Date of Patent: Apr. 2, 1991

[54] HAND HELD SAFETY SIREN

[76] Inventor: Rachel Halperin, 100 Antibes Drive, Suite 1105, North York, Ontario, M2R 3N1, Canada

[21] Appl. No.: 461,413

[22] Filed: Jan. 5, 1990

[51] Int. Cl.[5] ..... G08B 15/00

[52] U.S. Cl. ..... 340/574; 340/693

[58] Field of Search ..... 340/574, 693

[56] References Cited

U.S. PATENT DOCUMENTS 4,587,516 5/1986 Hiraki ..... 340/574

4,719,454 1/1988 Hopkins et al. ..... 340/574

*Primary Examiner*—Glen R. Swann, III

[57] ABSTRACT

The present invention provides a hand held alarm device for personal use. The alarm device comprises a housing having an alarm circuitry contained therein and a activating switch located thereon. The housing has an attachment strap for releasably attaching the alarm device to the hand such that the activating switch is maintained in a positon to be within reach of the fingers, both during and after a fright response. In an aspect of the invention, the alarm device includes a deactivating switch physically separated from the activating switch for deactivating the alarm device.

2 Claims, 1 Drawing Sheet

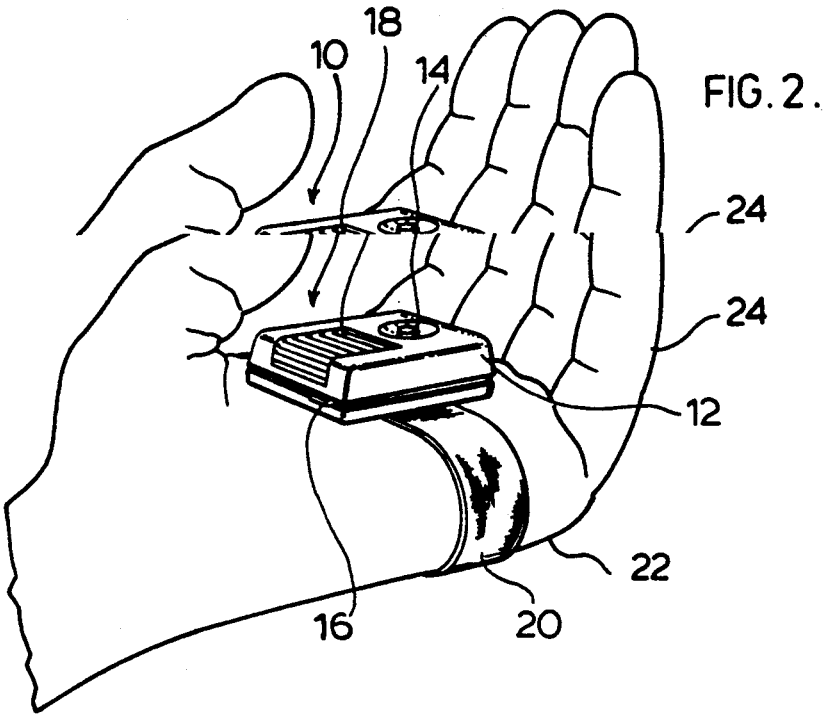
FIG. 2.
FIG. 1.
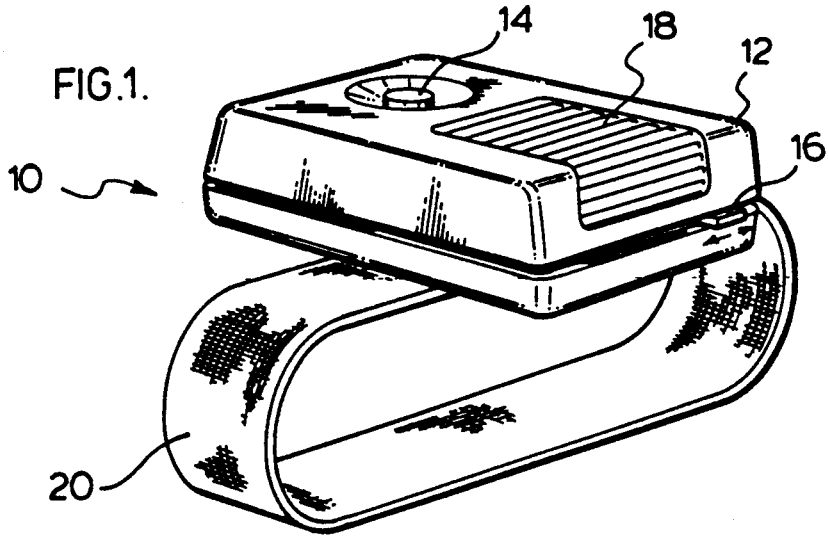
FIG. 3.
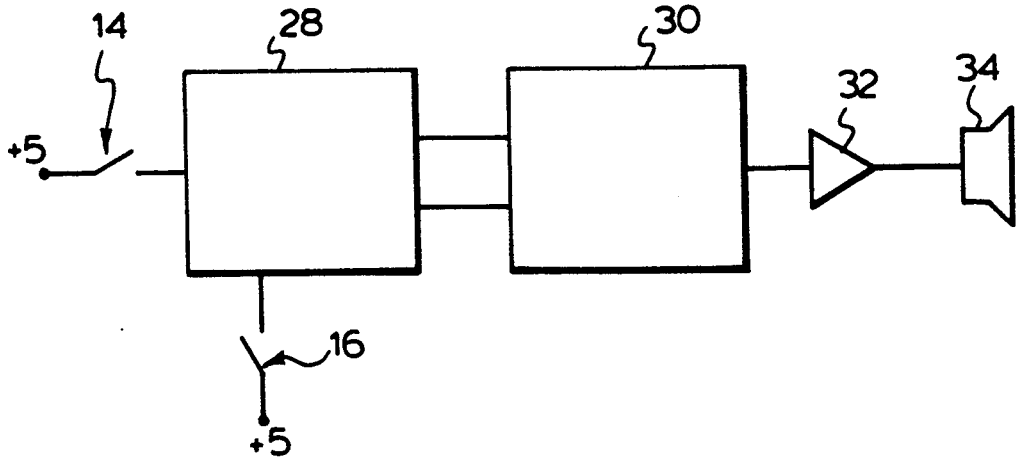

HAND HELD SAFETY SIREN

FIELD OF THE INvENTION

The present invention relates to a hand held alarm device for producing an audible alarm when activated.

BACKGROUND OF THE INVENTION

Presently, various personal alarm devices are available for use by persons, especially women, when walking at night. When the person carrying the alarm is in danger, particularly in danger of being attacked, the alarm can be activated and an audible alarm is emitted by the alarm device, the purpose of which is to scare off the potential attacker. Such devices, which are usually carried in the purse or preferably in the hand, suffer from drawbacks. One drawback is that most alarms are usually carried in the woman's purse and thus may be difficult to locate when needed. Additionally for alarms carried in the hand another drawback relates to the persons initial reaction to attack. One of the first reactions of a person about to be attacked is a fright reaction in which one automatically opens one's hands. With the presently available alarm devices, the person may drop the alarm device and have difficulty locating the device after recovering from such a reaction. Also, such devices can be easily inactivated by the attacker.

SUMMARY OF THE INVENTION

The present invention provides for a hand held alarm device for personal use. The alarm device comprises a housing having alarm circuitry contained therein and an activating switch located thereon. The housing further has an attaching means for releasably attaching the alarm device to the hand such that the activating switch is maintained in a position to be within reach of the fingers, even after the person may have had a fright response.

In an aspect of the invention, the alarm device includes a deactivating switch physically separated from the activating switch for deactivating the alarm device.

BRIEF DESCRIPTION OF THE DRAWINGS

The above as well as other advantages and features of the present invention will be described in greater detail according to the preferred embodiments of the present invention in which;

FIG. 1 is a perspective view of an alarm device made in accordance with a preferred embodiment of the present invention;

FIG. 2 is a perspective view of the alarm device of FIG. 1 in use: and

FIG. 3 a block diagram of the alarm device circuitry.

DETAILED DESCRIPTION ACCORDING TO THE PREFERRED EMBODIMENTS OF THE PRESENT INVENTION:

FIG. 1 illustrates an alarm device 10 made in accordance with a preferred embodiment of the present invention. The device 10 comprises a housing 12 of a size to fit comfortably within the palm of the hand of a person carrying the device. The housing is preferably constructed of an easily moldable material such as any of the commonly used polymers, e.g. polypropylene, polyethylene, etc. The device is preferably rectangular in shape, although, other shapes are possible and is preferably from about 2 to about 4 inches long, most preferably from about 2.5 to about 3.5 inches, from about 1 to about 2.5 inches wide, most preferably about 1.5 to about 2 inches, and from about 0.5 to 1.5 inches high, most preferably about 1 inch high.

The housing 12 has an activating switch 14, which as shown in FIG. 2, is located in a position to be within reach of the fingers 24 when the alarm is being carried and the person undergoes a fright response. Enclosed within the housing 12 is the alarm circuitry which will be explained further hereinbelow. Located remote from the activating switch 14, is a deactivating switch 16 for deactivating the alarm circuitry after the threat to the person has passed. In the embodiment shown, the deactivating switch is located at one side of the housing 12, although other positions, e.g. the bottom of the housing, are possible. The location is chosen such that the deactivating switch is physically separated from the activating switch and not easily identifiable and accessible by a potential attacker. Preferably the deactivating switch 16 is biased to the off position to reduce the likelihood of the switch being accidentally turned on. By locating the deactivating switch 16 remote from the activating switch 14 and hidden somewhat from view, it is more difficult for an attacker to deactivate the alarm 10 and thereby defeat its purpose.

The housing 12 has openings 18 at one end overlying the alarm emitting device of the alarm circuitry located within the housing 12.

Attached to the housing 12 is the attaching means 20 for releasably attaching the alarm device to the hand 22 as shown in FIG. 2 such that the activating switch 14 is maintained in a position to be within reach of the fingers 24, even after a fright response. In the embodiment illustrated, the attaching means 20 is an elastic strap of a size to comfortably encircle the hand 22 in the palm area and to maintain the alarm device 10 in a comfortable position in the palm. The elastic strap 22 can be a continuous strap or it can be a two part strap with fastening means to hold the two parts of the strap together, such as, for example, VELCRO, buckles, snaps or the like.

The details of the alarm circuitry are shown in FIG. 3. The alarm circuitry consists of a latch with reset 28 with the activating switch 14 connected to provide a high voltage for the latch when activated. The deactivating switch 16 is connected to provide a high voltage on the reset signal to deactivate the alarm circuitry. The output of the latch is fed to the audio signal generating device 30 such as an oscillator operating in the audible frequency range. The signal generating device 30 is activated when the output of the latch 28 is high and deactivated when the latch output is low (or its complement is high). The output from the signal generating device is in turn fed through an amplifier 32 to the alarm emitting device such as a loudspeaker 34.

It will now be seen how in accordance with the present invention, an alarm device, although extremely simple in its construction, is very effective for maintaining the activating switch in a position to be within reach of the fingers, even after a fright response. Furthermore, although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A hand held alarm device for personal use comprising a housing having a top surface, bottom surface and side surfaces, an alarm circuitry contained within said housing and a activating switch located on the op surface of said housing, said activating switch being provided in a recessed area surrounding said switch, said recessed area being enlarged relative to said switch, said housing having a attaching means for releasably attaching the alarm device to a hand such that the activating switch is maintained in a position to be within reach of the fingers of a user, even after a fright response.

2. A hand held alarm device as claimed in claim 1 wherein said alarm device includes a deactivating switch on one of said side surfaces of said housing physically separated from the activating switch for deactivating said alarm device.

* * * * *